US009302742B2

(12) United States Patent
Williams et al.

(10) Patent No.: US 9,302,742 B2
(45) Date of Patent: Apr. 5, 2016

(54) WAKEBOARD TOWER

(71) Applicant: Xtreme Marine Corporation, Maryville, TN (US)

(72) Inventors: Anthony Duane Williams, Maryville, TN (US); Bradley Michael Nemeth, Oak Ridge, TN (US); Robert Blaine Metcalf, Loudon, TN (US)

(73) Assignee: Xtreme Marine Corporation, Maryville, TN (US)

( * ) Notice: Subject to any disclaimer, the term of this patent is extended or adjusted under 35 U.S.C. 154(b) by 162 days.

(21) Appl. No.: 14/206,095

(22) Filed: Mar. 12, 2014

(65) Prior Publication Data

US 2014/0190392 A1 Jul. 10, 2014

Related U.S. Application Data

(63) Continuation-in-part of application No. 12/963,953, filed on Dec. 9, 2010, now Pat. No. 8,973,515.

(60) Provisional application No. 61/782,963, filed on Mar. 14, 2013.

(51) Int. Cl.
*B63B 15/00* (2006.01)
*B63B 35/81* (2006.01)

(52) U.S. Cl.
CPC ..... *B63B 15/00* (2013.01); *B63B 35/815* (2013.01)

(58) Field of Classification Search
CPC ..... B63B 17/02; B63B 15/00; B63B 35/815; B63B 17/00
See application file for complete search history.

(56) References Cited

U.S. PATENT DOCUMENTS

| | | | | |
|---|---|---|---|---|
| 104,474 | A | 6/1870 | Marshall | |
| 1,648,445 | A | 11/1927 | Crowell | |
| 2,152,605 | A | 3/1939 | Ragsdale et al. | |
| 3,026,841 | A * | 3/1962 | Pender | B60F 3/0038 114/283 |
| 3,121,924 | A | 2/1964 | Beisel | |
| 3,179,983 | A | 4/1965 | Webber et al. | |
| 3,666,605 | A | 5/1972 | Meyer et al. | |
| 3,724,595 | A | 4/1973 | Green | |
| 4,726,166 | A * | 2/1988 | DeRees | B62D 21/02 52/694 |
| 4,892,054 | A | 1/1990 | Davidson | |
| 5,052,326 | A | 10/1991 | Wiggen et al. | |
| 5,603,644 | A | 2/1997 | Kobayashi | |
| 5,964,173 | A | 10/1999 | Erskine et al. | |
| 6,192,819 | B1 | 2/2001 | Larson et al. | |
| 6,374,762 | B1 | 4/2002 | Larson et al. | |
| RE37,823 | E | 9/2002 | Larson et al. | |
| D462,932 | S | 9/2002 | Larson | |
| D480,349 | S | 10/2003 | Carlton | |
| 6,666,159 | B2 | 12/2003 | Larson et al. | |
| D486,441 | S | 2/2004 | Metcalf | |
| D489,314 | S | 5/2004 | Metcalf | |
| 6,792,888 | B1 | 9/2004 | Metcalf | |
| 6,925,957 | B2 | 8/2005 | Schultz | |
| 6,986,321 | B2 | 1/2006 | Metcalf | |

(Continued)

*Primary Examiner* — Edwin Swinehart
(74) *Attorney, Agent, or Firm* — Luedeka Neely Group, P.C.

(57) ABSTRACT

An arch shaped structural member suitable for use as a wakeboard tower including a pair of legs and a crosspiece supported by the legs, both of the legs and the crosspiece being a coreless cast structural member characterized as a cast structural member and devoid of a hollow interior enclosed by solid portions.

5 Claims, 8 Drawing Sheets

(56) References Cited

U.S. PATENT DOCUMENTS

| | | | |
|---|---|---|---|
| 7,013,830 | B1 | 3/2006 | Willis |
| 7,017,509 | B2 | 3/2006 | Schultz |
| 7,219,617 | B2 | 5/2007 | Metcalf |
| 7,299,761 | B2 | 11/2007 | Larson et al. |
| 7,392,758 | B2 | 7/2008 | Metcalf |
| 7,798,089 | B2 | 9/2010 | McKeand |
| 8,171,874 | B2 * | 5/2012 | Gasper ..... B63B 35/815 114/253 |
| 2006/0092649 | A1 | 5/2006 | Bynum |
| 2007/0137554 | A1 | 6/2007 | Metcalf |

* cited by examiner

WAKEBOARD TOWER

CROSS-REFERENCE TO RELATED APPLICATION

This application claims priority to U.S. Provisional Application Ser. No. 61/782,963 filed Mar. 14, 2013, entitled Wakeboard Tower, incorporated by reference herein in its entirety. This application is also a continuation-in-part of pending U.S. application Ser. No. 12/963,953, filed Dec. 9, 2010, entitled Wakeboard Tower System, which is incorporated by reference herein in its entirety.

FIELD

This disclosure relates to wakeboard towers for boats. More particularly, the disclosure relates to a wakeboard tower of modular construction including cast, coreless legs and a cross member.

BACKGROUND

Wakeboard towers and the service required of them in towing relatively heavy objects and the forces exerted thereon require that towers be structurally strong. Because of the strength requirements, the structural portions of such towers are of unitary structure.

While the unitary structural construction is strong, it is undesirable in that shipping and storage of the towers is complicated and expensive due to the large size of the towers. Also, in the event of damage to a portion of a tower, repair is impractical or difficult, necessitating replacement of the tower structure.

SUMMARY

The disclosure advantageously provides a wakeboard tower of modular construction that allows compact shipping and storage, and enables replacement of individual structural parts of the tower.

In one aspect of the disclosure, there is provided a wakeboard tower, including an arch shaped structural member suitable for use as a wakeboard tower with structural members having at least one leg and a crosspiece supported by the leg. At least one of the structural members is a structural member of coreless cast construction characterized as a cast structural member and devoid of a hollow interior enclosed by solid portions.

In another aspect of the disclosure, there is provided a wakeboard tower having a pair of legs each of coreless cast construction characterized as a cast structural leg devoid of a hollow interior enclosed by solid portions; and a crosspiece of tubular aluminum construction attached to the legs to provide an arch shaped structural member suitable for use as a wakeboard tower.

In yet a further aspect, there is provided a wakeboard tower having an arch shaped structural member suitable for use as a wakeboard tower including a pair of legs and a crosspiece supported by the legs, both of the legs and the crosspiece being a coreless cast structural member characterized as a cast structural member and devoid of a hollow interior enclosed by solid portions.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, the disclosure relates to a wakeboard towers having various structural components thereof made of coreless cast construction.

The use of tower components made of coreless cast construction advantageously enables the economical manufacture of suitably strong components as compared to conventional tower construction techniques. Further, such towers may be of reduced weight as compared to conventional towers. Also, in the event of damage to a portion of the tower, such portion may be easily replaced, which is advantageous over unitary towers.

Also, it has been discovered that wakeboard tower components of coreless cast construction according to the disclosure may be made to be compatible with wakeboard tower components of conventional construction.

For example, wakeboard towers are typically made of two leg components and a central crosspiece component. It has been discovered that wakeboard towers of sufficient strength may be made having the legs and the crosspiece made of coreless cast construction. Also, suitable towers may be made having legs of careless cast construction combined with crosspieces of conventional construction such as tubular aluminum construction. In addition, the crosspieces may be made of coreless cast construction and combined with legs of conventional construction such as tubular aluminum construction. Additional constructions include corners or partial legs or other structural features of coreless cast construction combined with components of conventional construction. Furthermore, if desired, a wakeboard tower wholly formed of coreless cast construction, either as a one-piece formed structure of a plurality of individual components may be provided.

The coreless cast construction is preferably coreless cast aluminum construction. However, in addition to aluminum, the careless cast structure may be made of other materials, such as other metals, moldable plastics, thermoformed plastics, fiberglass with or without foam reinforcement.

Figure 1:
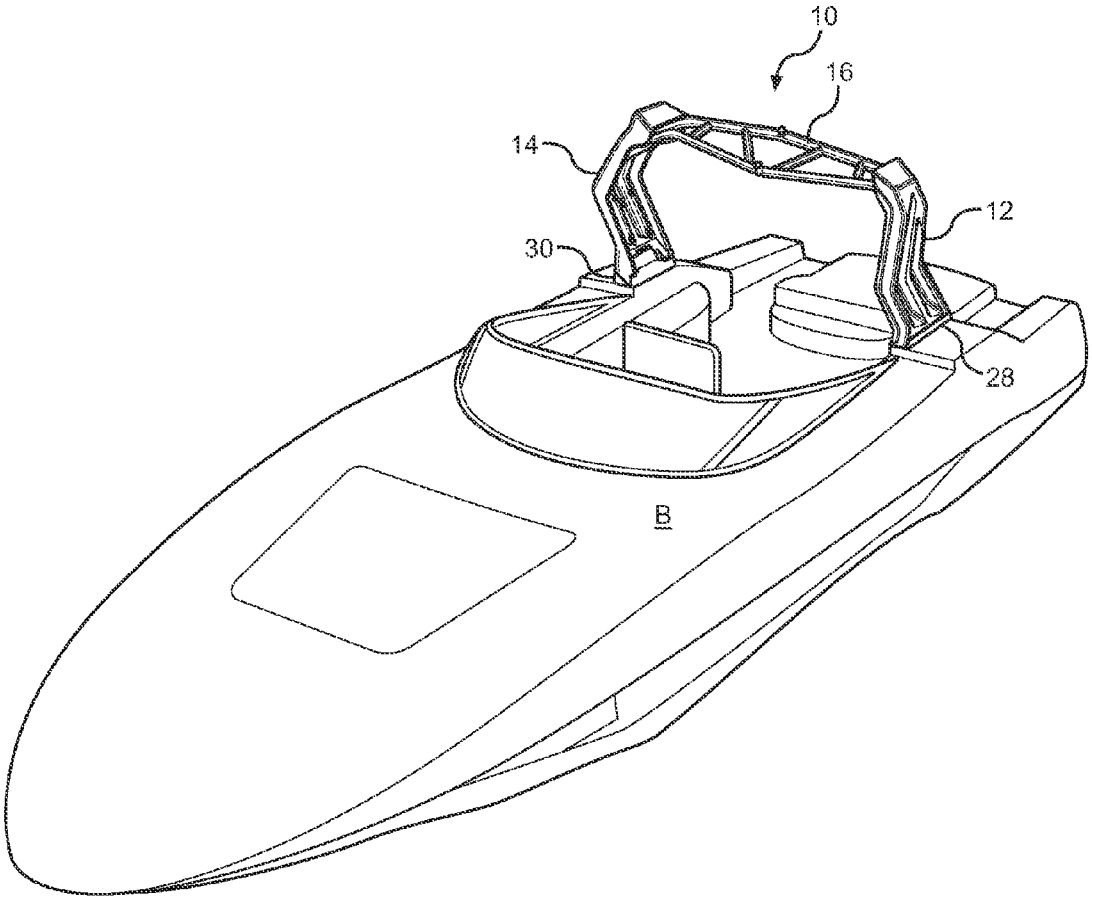
FIG. 1 shows a wakeboard tower according to the disclosure mounted onto a boat.
Figure 2:
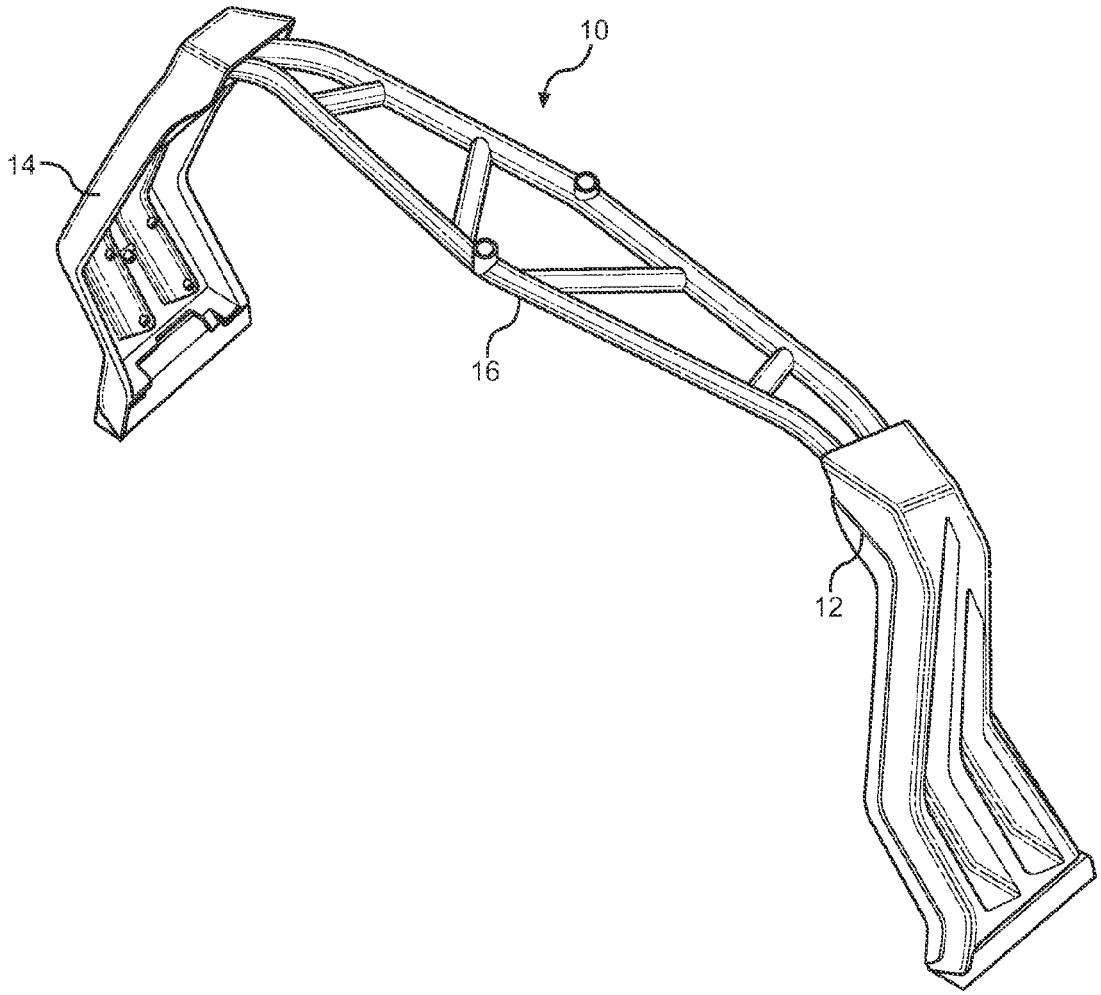
FIGS. 2 and 3 are perspective views of the tower of FIG. 1.
Figure 3:
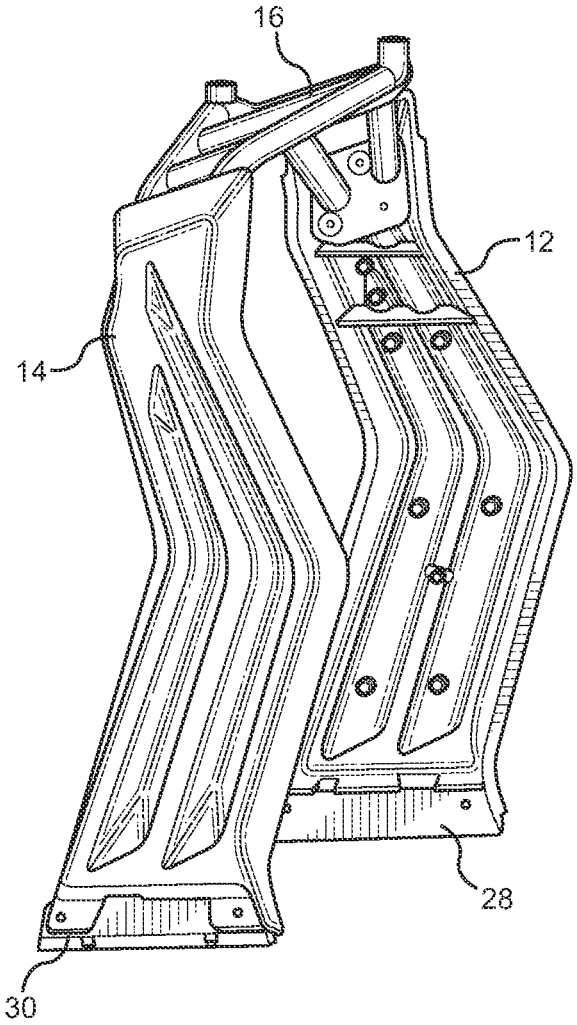

With reference to FIGS. 1-5, there is shown an example of a wakeboard tower 10 having legs 12 and 14 thereof of careless cast aluminum construction. The tower 10 also includes a crosspiece 16 of tubular aluminum construction and integrated with the legs 12 and 14. The tower 10 is generally configured in the shape of an arch mountable to the hull of a boat B so as to extend in a forward or bow direction, rising along its length, such as shown in FIG. 1.

The configuration of the legs 12 and 14 and the configuration of the crosspiece 16 enable the crosspiece 16 to be mounted to the legs 12 and 14 by bolts and provide a strong tower structure. The crosspiece 16 may include one or more tow points 18. Opposite ends of the crosspiece 16 may include mounts 20 and 22 to facilitate mounting of the crosspiece 16 to the legs 14 and 16, respectively.

Figure 4:
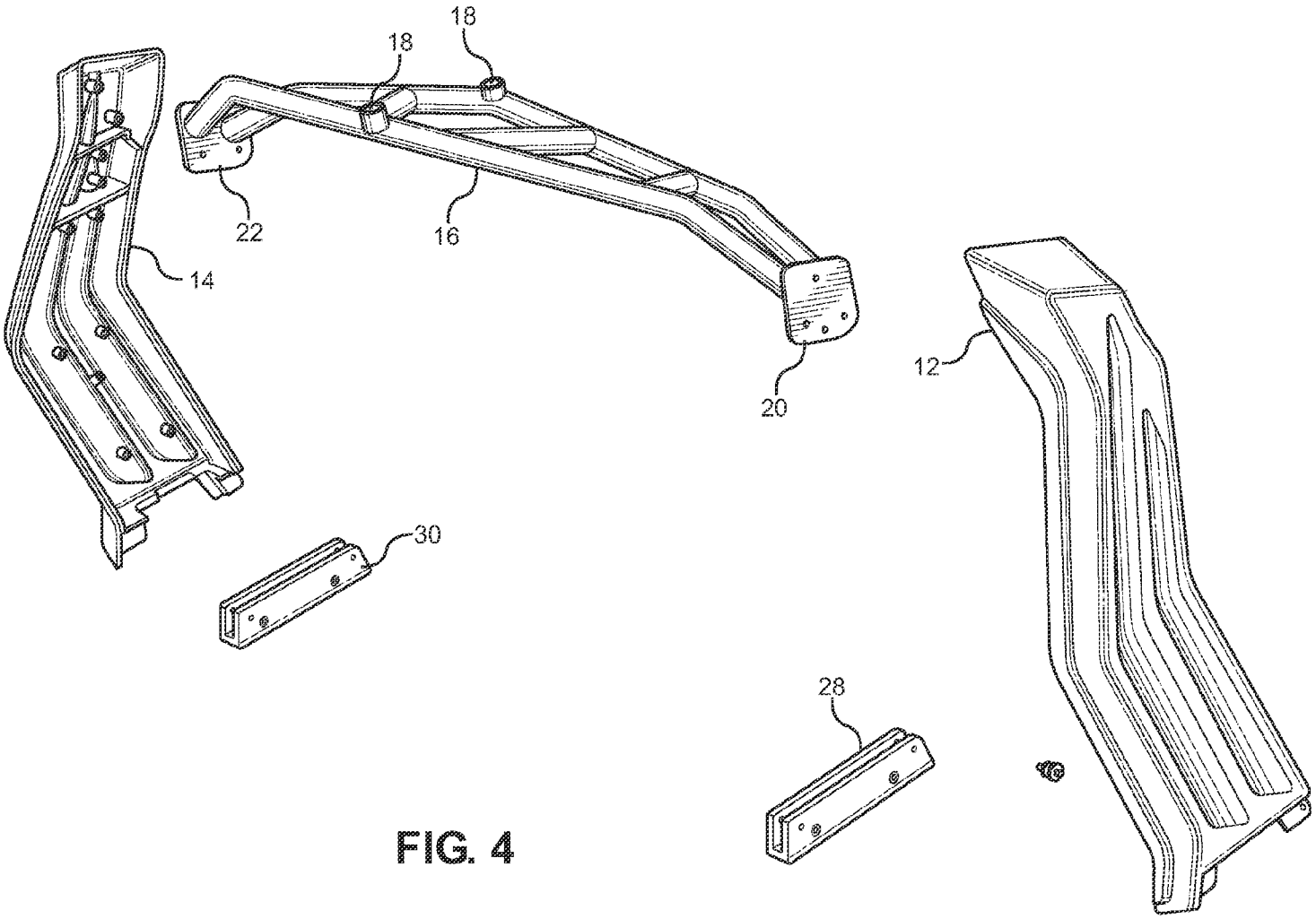
FIG. 4 is an exploded view of the tower of FIGS. 2 and 3.
Figure 5:
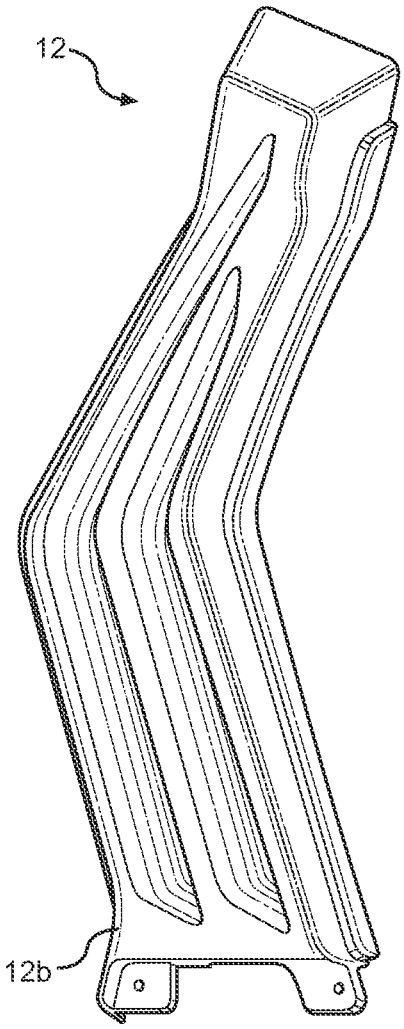
FIGS. 5 and 6 show a leg of the tower of FIG. 1.
Figure 6:
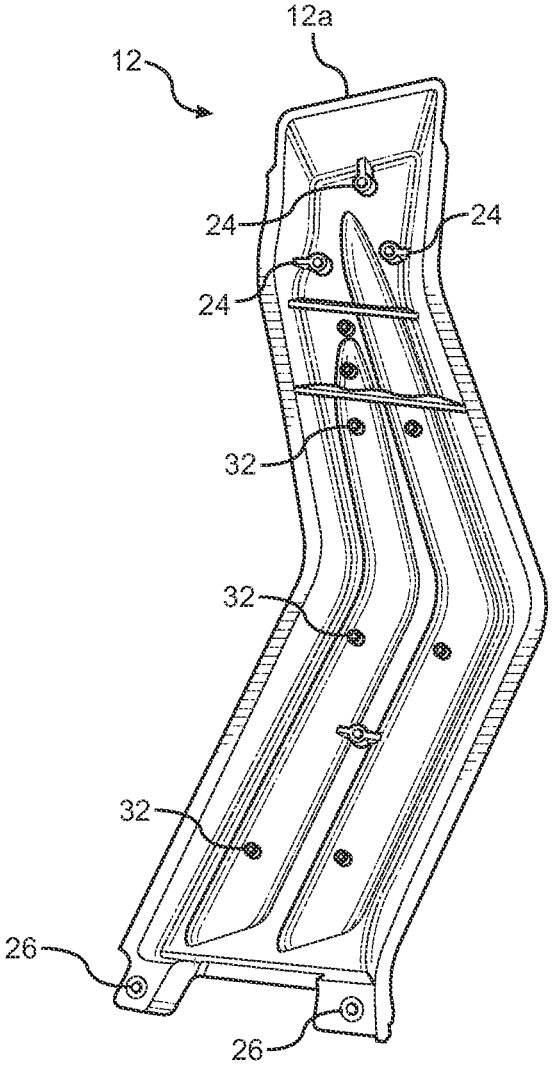
Figure 7:
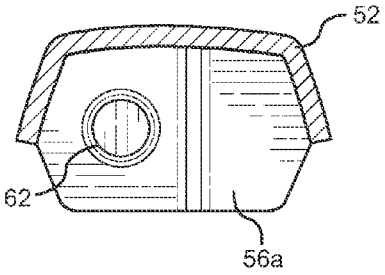
FIGS. 7 and 8 show careless cast tower components according to the disclosure including removable, nonstructural panels.
Figure 8:
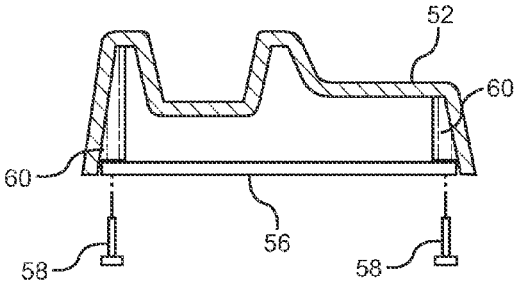
Figure 9:
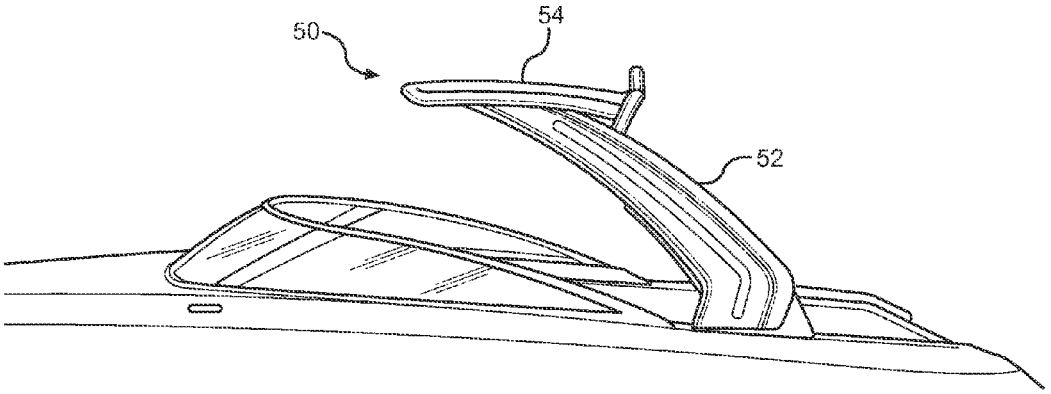
FIGS. 9 and 10 shows a wakeboard tower according to the disclosure having legs made of coreless cast construction according to the disclosure and incorporating removable, nonstructural panels.
Figure 10:
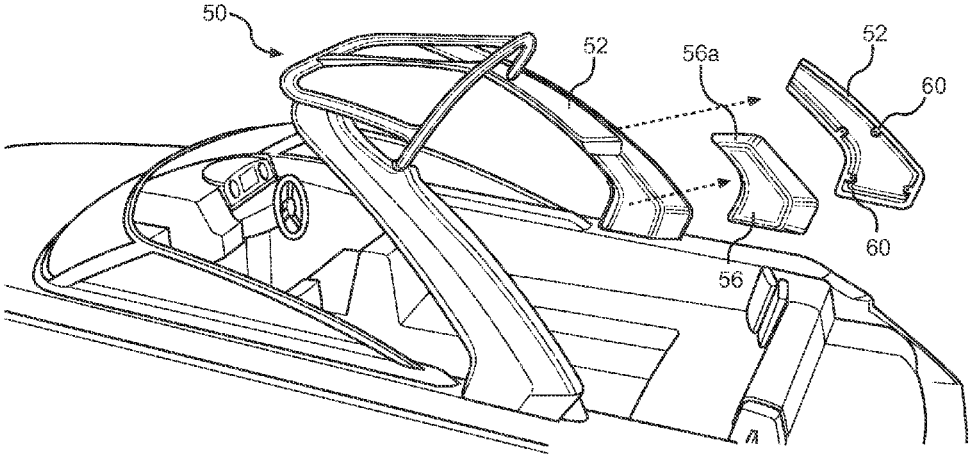

With reference to FIGS. 4 and 5, the leg 12 is of coreless cast construction, preferably of coreless cast aluminum construction. An upper end 12*a* of the leg 12 is configured to have bosses 24 for mounting to the mount 20 of the crosspiece 16. An opposite lower end 12*b* of the leg 12 is configured to have bosses 26 for mounting to a base 28 attached to a gunwale of a hull of the boat B. The leg 14 is substantially identical to the leg 12, except provided as a mirror-image for mounting on the opposite side of the boat hull.

The legs 12 and 14 as shown have a generally concave configuration with a recess disposed on the side of the legs facing the interior of the boat. The leg 14 mounts to a base 30 attached to an opposite gunwale of the hull of the boat B. The legs 12 and 14 may include corrugated ridges/indentions to provide reinforcement as well as an aesthetically attractive design.

As described above, the leg 12 is made of coreless cast construction. Conventional wakeboard tower legs are made of hollow aluminum tubing. Contrary to this, it will be appreciated that the leg 12 does not include a hollow interior center portion. Hence, the term coreless as used herein will be understood to mean that the structure does not have a hollow interior enclosed by solid portions.

The leg 12 may be cast using a pair molds each formed by tightly packing sand around the pattern shape, Each mold forms one half of the shape of the leg 12. One mold is a negative shape of the outer surface of a pattern. The other mold is a negative shape of the inner surface of a pattern. The mold halves may be determined by dividing the leg 12 around the outermost edges, or perimeter of the leg 12 to create apart line. One mold half will be the top half. The top half has extra details added to assist in the casting process. Added, is at least one hole to allow molten material, such as molten aluminum, to be poured into the mold and one or more vent holes to allow air and excess material to escape.

To produce the leg 12, the molds are mated together so the part line on each half mold match. This creates a hollow inner cavity in the shape of the leg 12, but does not form a hollow interior core. Molten aluminum is poured into the receiving hole on the top half. Gravity makes the molten material flow into the hollow cavity. Air escapes through the vent holes. When there is sufficient material poured to fill the cavity, excess material escapes through the vent holes. When the molten material has cooled, the sand molds may be knocked off, leaving one copy of the original pattern, including the additional shapes of the pouring and venting holes. The pouring and venting portions are cut off and ground smooth so that all surfaces match the desired part. Successive copies may be made by repeating the process. The leg 14 may be made in a similar manner. The legs desirably have a thickness of ⅛"-2", which may vary along different sections of the leg as desired for sufficient strength while minimizing weight.

If the tower 10 is to be painted, the legs 12 and 14 may be ground smooth, such as by hand. If the tower 10 will be coated with a textured paint or a vinyl wrap, minimal hand finishing is required to prepare the surface.

The bases 28 and 30 may be made as by extrusion or may also be of coreless cast construction and made in the manner described for the leg 12. The bases 28 and 30 are mounted to the gunwale with bolts through the bases 28 and 30 and the gunwales. For example, bolts may be secured under the boat deck with nuts. Alternatively, the bases 28 and 30 may have threaded studs protruding from the underside designed to pass through the deck and be secured with nuts below deck. The legs 12 and 14 may be bolted onto the bases 28 and 30, respectively. One bolt may allow the leg to pivot while the other bolt secures the leg in an upright position. Alternately, other pivoting mechanisms may be used. In other embodiments, all bolts may securely maintain the leg in an upright position.

Accessories such as bimini, speakers and board racks may be attached to the legs 12 and 14 or the crosspiece 16 as with bolts. Bosses 32 to receive bolts may be strategically positioned for optimal position of each accessory. The bosses 32 may all extend from the leg with parallel axes to allow for ease of machining bolt holes in the bosses 32 in a single plane. Various clamping mechanisms may also be used to secure accessories to the legs or arch. Additionally, various channel features may be incorporated into or attached to the legs 12 and 14 or the crosspiece 16 to provide routing for electrical wire, tubing, or ventilation paths. Furthermore, various press-fit clamping mechanisms may be located along the interior of the channel for receiving wiring and tubing.

The modular design of the tower 10 advantageously enables the different structural parts of the tower 10 to be replaced should one part become damaged or be deemed defective. Also, the tower 10 may be shipped or stored or the like in a disassembled and compact configuration. Furthermore, the careless cast construction of components of the tower provides an aesthetically pleasing appearance, decreases cost of production, and provides usable surfaces on the components for mounting various types of accessories.

The use of components of coreless cast construction is further advantageous in that it provides a structure that is economical to produce and can readily accommodate decorative interior panels and the like which can be mechanically attached or bonded directly to the exterior of the coreless cast aluminum leg or other tower structure. For example, the coreless cast legs 12 and 14 may include decorative panels covering recesses on the interior sides or other portions of the legs, such as described in pending U.S. patent application Ser. No. 12/963,953, entitled "Wakeboard Tower System," the entirety of which is incorporated herein by reference.

Currently in towers made from solid structures, accessories must be attached to an already finished surface. The interior panels provide a high quality finish that complements other interior surfaces, providing a more comfortable interior area than if the hard structure were exposed. The arch makes the interior more comfortable instead of being comprised only of hard surfaces. The arch completes the interior.

The hollow space may be configured with areas to mount accessories such as speakers, accent lights, fans, misting devices, or other creature comforts. The hollow space allows all the accessories to be easily installed on the hollow shell during the manufacturing process or easily installed at the dealer. The finished panels hide all the mechanical features.

To achieve a variety of looks and price points, the panels may completely cover the hollow area or any portion thereof. For instance a partial panel will cost less than a fun panel. A partial panel would allow part of the hollow structure to be exposed, offering a more rugged appearance.

In this regard, and with reference to FIGS. 7-10, there is shown a tower 50 having one or more legs 52 thereof of coreless cast aluminum construction. The tower 50 also includes a crosspiece 54 of tubular aluminum construction and integrated with the legs 52.

The leg 52 may include a removable, nonstructural decorative panel 56 secured as by fasteners 58 to bosses 60 formed with the leg 52. An upper surface 56*a* of the panel 56 is shown formed to include a cup holder 62, providing additional functionality to the leg 52.

Figure 11:
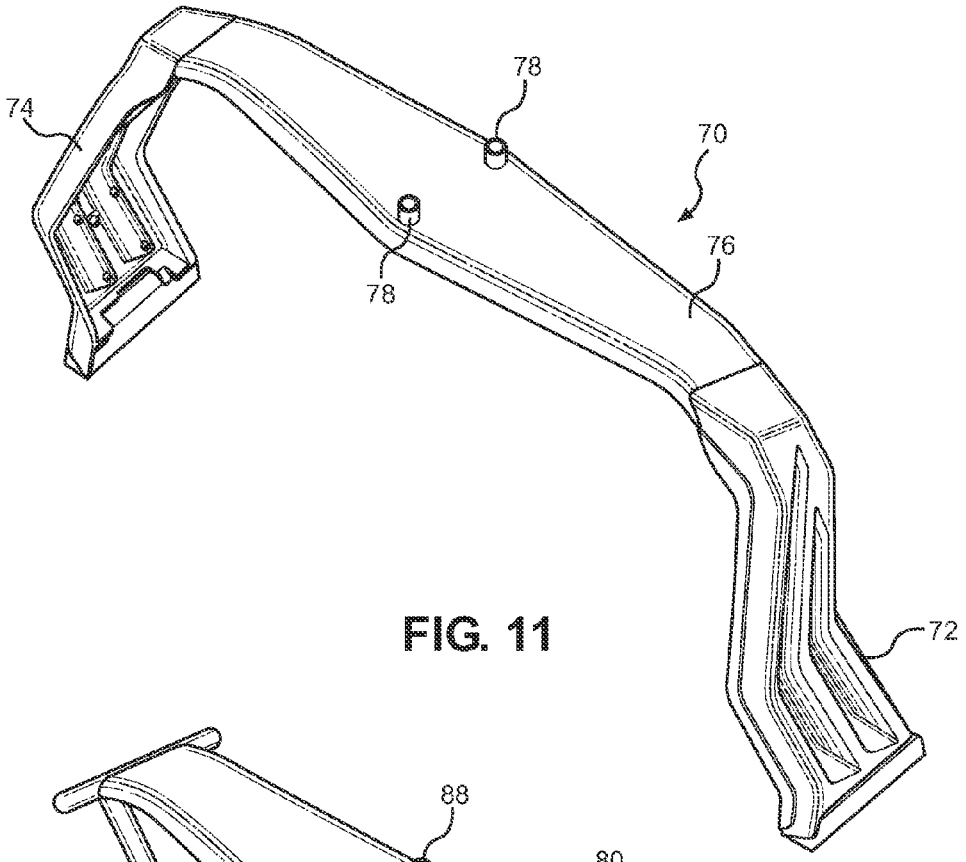
FIG. 11 shows a wakeboard tower according to the disclosure made entirely of coreless cast construction.

FIG. 11 shows an embodiment of a wakeboard tower 70 made entirely of coreless cast construction, having legs 72 and 74 and crosspiece 76 of coreless cast construction. The crosspiece 76 includes tow points 78 cast therewith or formed of metal and secured thereto as by fasteners.

Figure 12:
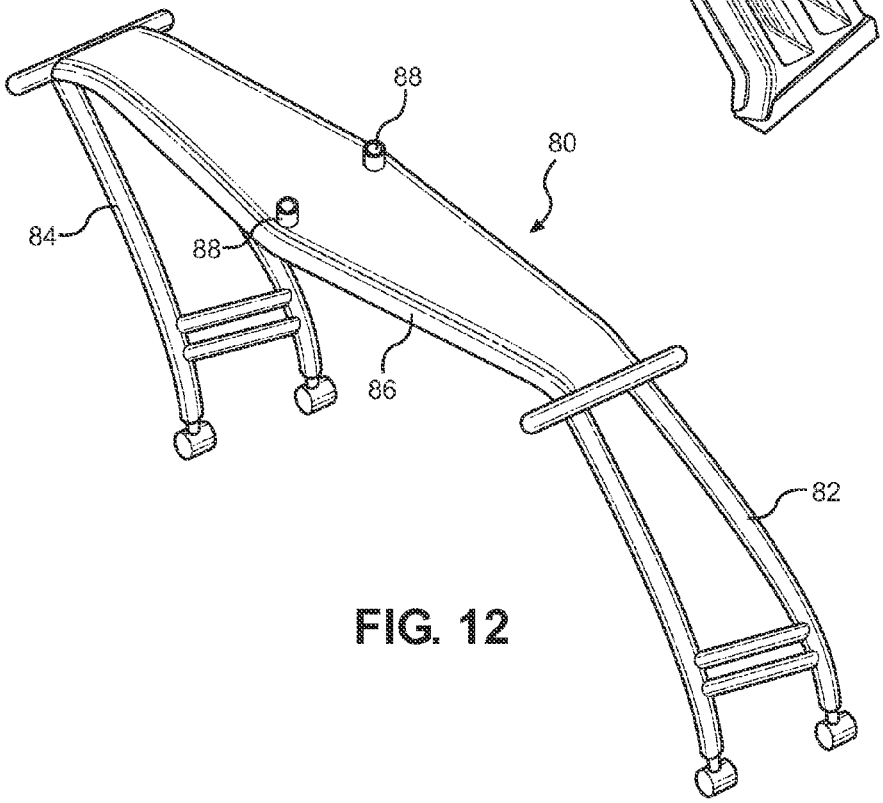
FIG. 12 shows a wakeboard tower according to the disclosure having a crosspiece made of coreless cast construction and legs of conventional tubular aluminum construction.

FIG. 12 shows an embodiment of a wakeboard tower 80 having legs 82 and 84 of conventional tubular aluminum construction, and a crosspiece 86 made of coreless cast construction including tow points 88.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A wakeboard tower, comprising:

an arch shaped wakeboard tower comprising at least two legs, each leg comprising an interior side facing an interior of a boat when mounted to the boat and an opposite exterior side facing away from the interior of the boat, a crosspiece supported by the legs, and a tow point, wherein the interior sides of the legs comprise a concave configuration with a recess disposed thereon and wherein, when the legs are mounted on a boat, the legs comprise a coreless cast construction characterized as a cast structural member and devoid of a hollow interior enclosed by solid portions.

2. The wakeboard tower of claim 1, wherein the leg includes bosses formed within the recess and the leg further includes a removable decorative panel secured adjacent the recess by fasteners cooperating with the panel and the bosses.

3. The wakeboard tower of claim 1, wherein the structural member of coreless cast construction is made of cast aluminum.

4. A wakeboard tower, comprising:

a pair of legs, each leg comprising an interior side facing an interior of a boat when mounted to the boat and an opposite exterior side facing away from the interior of the boat wherein the interior sides of the legs comprise a concave configuration with a recess disposed thereon and wherein, when the legs are mounted on a boat, the legs each comprise a coreless cast construction characterized as a cast structural leg devoid of a hollow interior enclosed by solid portions; and a crosspiece of tubular aluminum construction attached to the legs to provide an arch shaped structural member suitable for use as a wakeboard tower.

5. A boat comprising a windshield and a raised structural member comprising a first leg extending substantially upwardly from a first side of the boat at a first location aft of the windshield, a second leg extending substantially upwardly from a second side of the boat at a second location aft of the windshield, and a cross member bridging an upper portion of the two legs, each leg having a concave configuration with an intermediate recessed section, and a removable decorative panel attached to an interior side of each leg so that the intermediate section is covered by the decorative panel.

* * * * *